US006045241A

United States Patent [19]

Pahl

[11] Patent Number: 6,045,241

[45] Date of Patent: Apr. 4, 2000

[54] LIGHTING TRIM RETAINING APPARATUS

[75] Inventor: Scott Pahl, San Leandro, Calif.

[73] Assignee: Prescolite-Moldcast Lighting Company, San Leandro, Calif.

[21] Appl. No.: 09/121,164

[22] Filed: Jul. 23, 1998

[51] Int. Cl.[7] ..... F21S 1/06; F21S 3/06

[52] U.S. Cl. ..... 362/365; 362/147; 362/364; 362/368

[58] Field of Search ..... 362/147, 148, 362/364, 365, 368, 374; 248/202.1, 221.11, 222.41

[56] References Cited

U.S. PATENT DOCUMENTS 3,983,387 9/1976 Van Steenhoven ..... 240/147

5,172,976 12/1992 Bogdanovs ..... 362/374

5,410,462 4/1995 Wolfe .

*Primary Examiner*—Cassandra Spyrou

*Assistant Examiner*—Leo Boutsikaris

*Attorney, Agent, or Firm*—Theodore J. Bielen, Jr.

[57] ABSTRACT

An apparatus for retaining a trim to a lighting fixture utilizing a frame which is fixed relative to a surface at which the lighting fixture is mounted. The frame includes an opening and a surface surrounding the opening. One or more brackets are placed along the frame surface. A movable element of one bracket connects to the trim for support. Retaining of the trim is a accomplished by further fastening of the trim to another bracket placed along the surface surrounding the opening of the frame.

14 Claims, 2 Drawing Sheets

LIGHTING TRIM RETAINING APPARATUS

BACKGROUND OF THE INVENTION

The present invention relates to an apparatus for retaining a trim to a lighting fixture.

Lighting fixtures, such as recessed fixtures are often installed in ceilings and in walls within buildings. Typically, the recessed lighting fixture includes a frame or can structure which lies within the ceiling or wall and serves to support a reflector and lamp, as well as the necessary electrical elements. Normally, a trim is placed over the recessed lighting fixture for the purpose of diffusion of light and/or for decoration. U.S. Pat. No. 5,410,462 depicts a modular recessed lighting fixture utilizing a frame and typical electrical and mechanical components, which is incorporated by reference hereto in its entirety.

In the past, it has proven quite difficult to install such trims, which can be quite bulky and heavy in certain instances. Moreover, removal of the trim is required to relamp the fixture at various intervals. Further, installation or removal of a trim from a recessed lighting fixture can pose a safety hazard if such trim is dropped during these operations. Finally, damage to the trim results if the same is dropped, requiring replacement of the same at a notable expense.

A system for retaining a trim on a recessed light fixture would be a significant advance in the lighting field.

SUMMARY OF THE INVENTION

In accordance with the present invention a novel and useful trim retention mechanism for a recessed light is herein provided.

The apparatus of the present invention is usable with a trim for a lighting fixture mounted to a wall or ceiling. The lighting fixture generally includes a lamp and a reflector which is recessed relative to the mounting surface. The light fixture is also generally provided with a plaster frame or plate, and includes a distending rim having an inner surface defining the opening, through which light travels from the lamp of the lighting fixture.

The apparatus of the present invention includes as one of its elements a first bracket connected to the frame. The first bracket possesses a first portion placed along the rim surface and a second portion which extends outwardly from the rim. The first bracket second portion could be in the form of a movable element, such as one that is hingedly attached to the first portion of the first bracket. First fastening means permits connection of the bracket to the plaster frame or plate. Such connection may be an adjustable connection to accommodate walls or ceilings of varying thickness. The first bracket may be fastened directly to an anchor or clip which may be placed in a series of preformed openings in the plate or into openings which are created de novo to fasten the anchor. The first bracket also possesses second fastening means for connecting the movable element to the trim. Thus, the trim connected to the second portion of the first bracket would naturally hang vertically, leaving the opening through the plaster frame and rim accessible for maintenance or installation of items such as lamps and the like.

The apparatus of the present invention also possesses a second bracket connected to the plaster frame. The second bracket includes a first portion similar to the construction of the first bracket first portion. That is to say, third fastening means, of similar construction to the first fastening means, permits the connecting of the second bracket to the plaster frame such that the bracket is adjustable along the surface of the rim to accommodate ceilings, walls, and the like of varying thicknesses. Fourth fastening means allows the connecting of the trim to the second portion of the second bracket such that the trim has been fixed in its intended position relative to the lighting fixture recessed in the wall or ceiling. The fourth fastening means may take the form of a slot which engages a flange or protuberance on the trim to hold the same in place. It should be noted that the trim may be rotated into the slot of the fourth fastening means to accomplish such interconnection between the trim and the second portion of the second bracket.

It may be apparent that a novel and useful apparatus for retaining a trim to a lighting fixture has been described.

It is therefor an object of the present invention to provide an apparatus for retaining a trim to a lighting fixture which greatly eases the installation of a trim on the exterior mounting surface of a wall or ceiling holding the lighting fixture.

It is another object of the present invention to provide an apparatus for retaining a trim to a lighting fixture recessed in a wall or ceiling that facilitates the relamping of such lighting fixture and eliminates interim support of the lighting fixture trim and the unfastening of decorative nuts.

A further object of the present invention is to provide an apparatus for retaining a trim to a recessed lighting fixture in a wall or ceiling which is unobtrusive and does not detract from the esthetics of the trim itself.

A further object of the present invention is to provide an apparatus for retaining a trim to a lighting fixture which is retrofitable to a standard lighting structure.

Another object of the present invention is to provide an apparatus for retaining a trim to a lighting fixture recessed in a wall or ceiling which is easily adjustable to varying thicknesses of the wall or ceiling.

A further object of the present invention is to provide an apparatus for retaining a trim to a lighting fixture which greatly reduces hazards associated with the installation and maintenance of the lighting fixture through the falling of objects downwardly.

The invention possesses other objects and advantages especially as concerns particular characteristics and features thereof which will become apparent as the specification continues.

Figure 1:
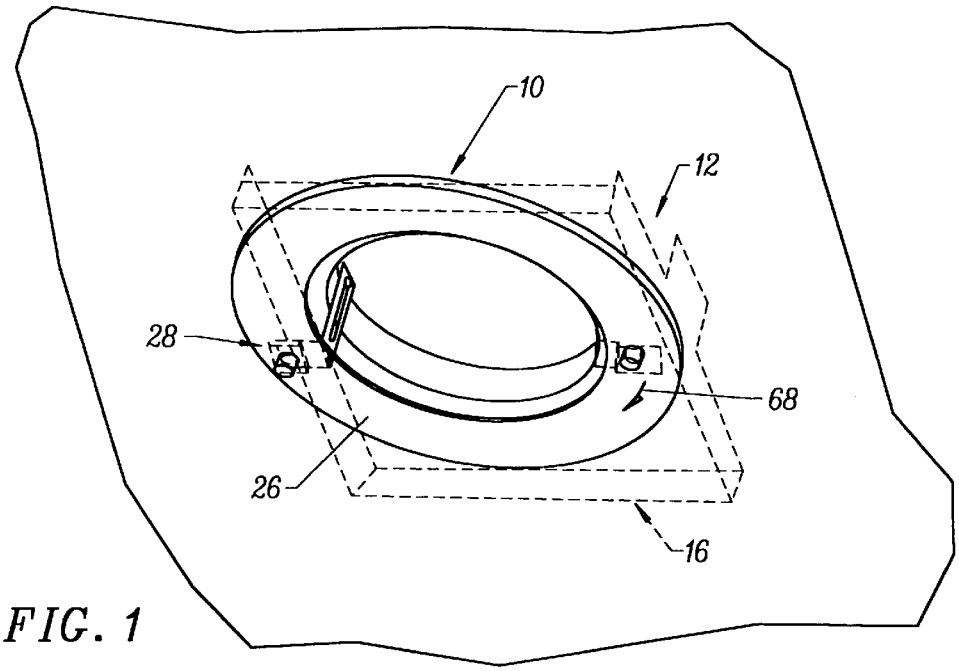
FIG. 1 is a bottom right perspective view of a trim in place on a recessed lighting fixture utilizing the apparatus of the present invention.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be referenced to the heretofore described drawings.

The invention as a whole is shown in the drawings by reference character 10. Apparatus 10 is employed in conjunction with recessed lighting fixture 12, which is schematically depicted in the drawings. Recessed lighting fixture 12 is placed at a mounting surface 14 such as a ceiling or wall. In the drawings, mounting surface 14 is shown as a ceiling. Lighting fixture 12 includes a frame 16 which is formed with a circular rim 18 having a curved surface 20 which defines opening 22. Opening 22 permits light from lamp 24, shown schematically in FIG. 3, to emanate therethrough. Recessed lighting fixture 12 also includes the necessary electrical components above ceiling 14 (not shown).

Apparatus 10 is intended to hold trim 26 to lighting fixture 12. Needless to say, trim 26 is represented as a typical structure. Trim 26 may include ornamental elements and fragile portions. In addition, trim 26 may be relatively heavy and difficult to handle when being installed against a ceiling such as ceiling 14.

Figure 3:
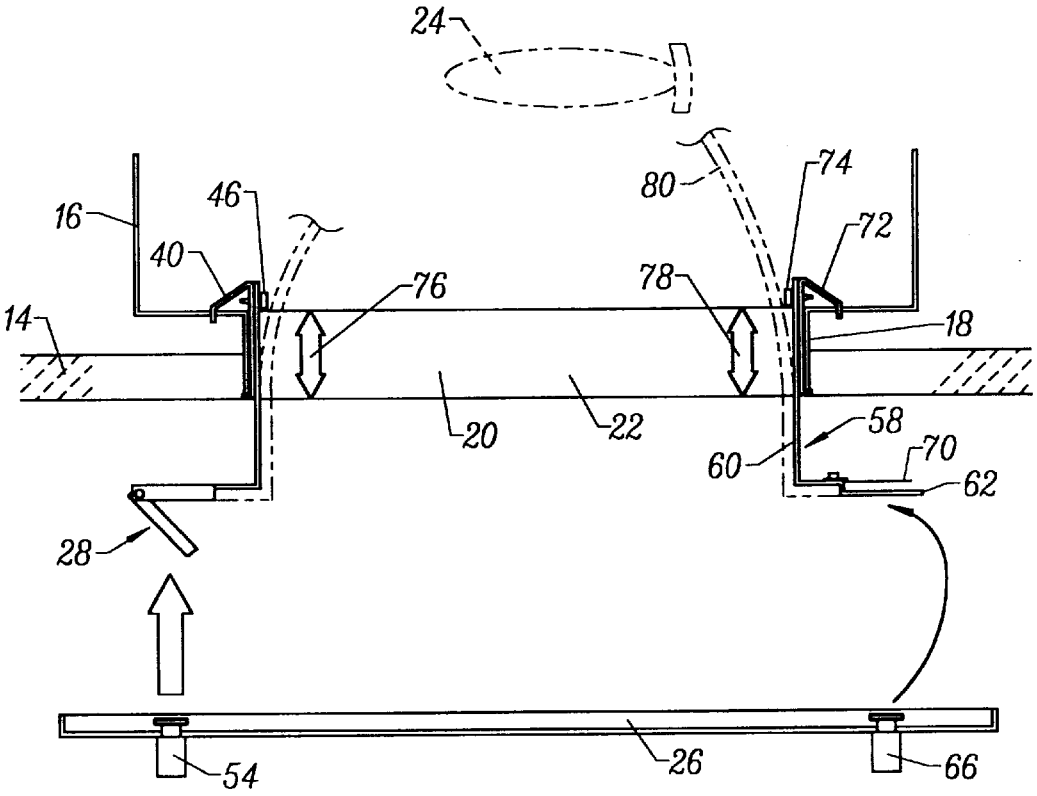
FIG. 3 is a sectional view of the apparatus of the present invention in place, with the trim depicted in exploded configuration relative to the trim retaining apparatus of the present invention.
Figure 4:
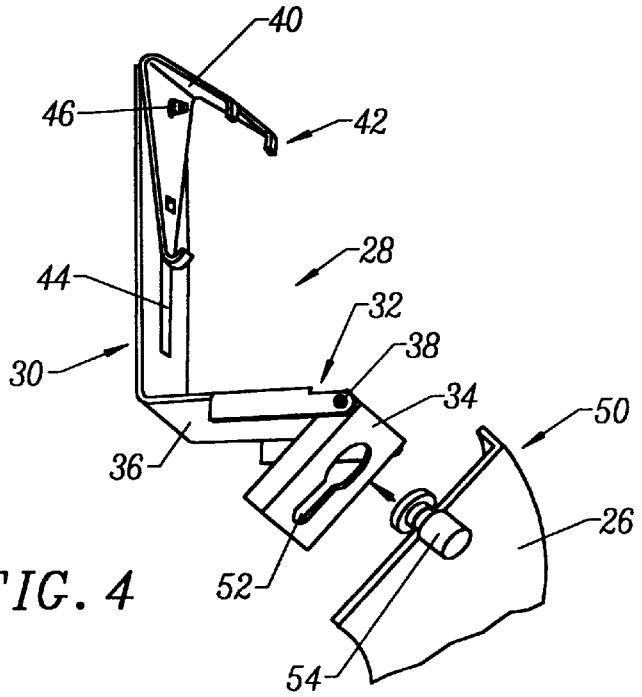
FIG. 4 is a bottom left perspective view of the first bracket and fastening means of the apparatus of the present invention.

The invention 10 includes as one of its elements a first bracket 28, which is depicted in detail on FIG. 4, and is illustrated as being connected to trim 26 in the remaining figures. Bracket 28 includes a first portion 30 and a second portion 32. Second portion 32 also includes a movable element 34 which is hingedly attached to horizontal portion 36 by the use of a pivot pin 38. First portion 30 of bracket 28 connects to frame or plate 16 by the use of an anchor 40. Anchor 40 includes plurality of prongs 42 which fit into openings within frame 16. Thus, anchor 40 is capable of snapping into place at opening 22 of frame 16 as depicted in FIG. 3. It should be understood that anchor 40 may be fixed by other means to frame 16. Returning to FIG. 4, it should be understood that first bracket 28 has been rotated for the sake of viewing clarity. First portion 30 includes a slot and a set screw 46 which serves as means 48 for adjustably fastening or connecting first bracket 28 to frame 16. It should be noted that first portion 30 of first bracket 28 lies against curved rim surface 20, in this regard.

Figure 2:
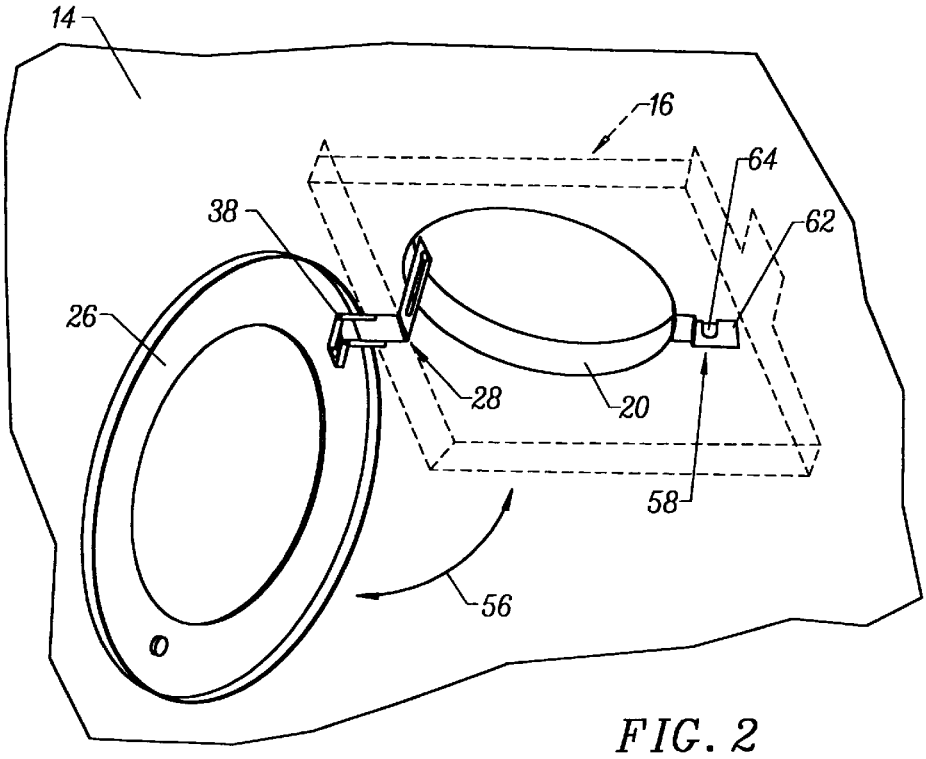
FIG. 2 is a bottom right perspective view of a trim hinged away from the opening of the recessed lighting fixture and held in that position by the apparatus of the present invention.

Means 50 is also depicted in the drawings for connecting movable part or element 34 of second portion of bracket 28 to trim 26. Means 50 includes the provision of a keyhole slot 52 which accepts flanged nut 54 fastened to trim 26. That is to say, the flange portion of flange nut 54 slips into the narrowed portion of slot 52 to hold trim 26 in place, as depicted in FIG. 2. Directional arrow 56 indicates that trim 26 may be rotated along the axis of pivot pin 38.

Second bracket 58, best shown in FIGS. 2 and 3, includes a first portion 60 and a second portion 62. First and second portions 60 and 62 of second bracket 58 are angularly disposed relative to one another, but are not articulated. Second portion 62 includes an open slot 64 for accepting flanged nut 66 on trim 26. Referring to FIG. 1, it may be observed that directional arrow 68 indicates that flanged nut 66 is rotated into position about a axis of flanged nut 54 on the other end of trim 26. Plate 70 possesses a slight spring action to hold flange nut 66 in place, following insertion within open slot 64. Thus, trim 26 may be rotated upwardly along directional arrow 56, FIG. 2 and into place, as shown in FIG. 1.

First portion 60 of second bracket 58 connects to an anchor 72 which may be snapped, or otherwise fixed, into place, in a similar manner to anchor 40. In fact, anchor 72 is identical in shape to anchor 40 in this regard. Again, first portion 60 includes a slot similar to slot 44 (not shown) which permits the use of set screw 74 to adjustably attach first portion 60 of second bracket 58 to frame 16 via anchor 72.

In operation, apparatus 10 is utilized by the installing of first bracket 28 and second bracket 58 to frame 16 via anchors 40 and 72, respectively. Anchors 40 and 72 are snapped into place by utilizing openings found in frame 62 for this purpose. Set screws 46 and 74 permit the upward or downward movement of first portions 46 and 60 of first and second brackets 28 and 58, respectively, according to directional arrows 76 and 78 of FIG. 3. Means 50 is employed to connect trim 26 to movable portion 34 of bracket 28. Specifically, flange nut 54 is placed within keyhole slot 52. At this point, trim 26 may hang downwardly as depicted in FIG. 2, although flange nut 54 permits rotation of trim 26 about the axis of flange nut 54. Trim 26 is then rotated into place along directional arrow 56 such that flange nut 66 fits within open slot 64 of second bracket 58. Spring plate 70 holds flange nut 66 in this position. It should be noted that reflector 80 and lamp 24, shown in phantom in FIG. 3, is placed against surface 20 and brackets 28 and 58 prior to the installation of trim 26 in certain cases.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for retaining a trim to a lighting fixture having a lamp held relative to a mounting surface, and possessing a frame fixed relative to the mounting surface, the frame further possessing an opening there through for permitting passage of light from the lighting fixture lamp, the frame further including a surface surrounding the opening, comprising:

a. a first bracket connected to the frame, said first bracket including a first portion placed along the frame surface surrounding the opening and a second portion extending outwardly from the frame surface surrounding the opening, said first bracket second portion including a movable element;

b. first fastening means for connecting said first bracket to the frame;

c. second fastening means for connecting said movable element to the trim, said second fastening means for connecting said movable element to the trim comprising means for hingedly attaching said movable element to the trim;

d. a second bracket connected to the frame, said second bracket including a first portion placed against the frame surface surrounding the opening, and a second portion extending outwardly from the frame surface;

e. third fastening means for connecting said second bracket to the frame; and f. fourth fastening means for connecting the trim to said second portion of said second bracket.

2. The apparatus of claim 1 in which said second fastening means for connecting said movable element to the trim further comprises a slot through said movable element.

3. The apparatus of claim 1 in which said fourth fastening means includes means for permitting rotation of the trim relative to the surface surrounding the opening of the frame.

4. The apparatus of claim 3 in which said means for permitting rotation of the trim relative to the surface surrounding the opening comprises a slot in said second portion of said second bracket.

5. The apparatus of claim 4 in which said second fastening means for connecting said movable element to the trim comprises means for hingedly attaching said movable element to the trim.

6. The apparatus of claim 5 in which said second fastening means for connecting said movable element to the trim further comprises a slot through said movable element.

7. An apparatus for retaining a trim to a lighting fixture having a lamp held relative to a mounting surface, and possessing a frame fixed relative to the mounting surface, the frame further possessing an opening there through for permitting passage of light from the lighting fixture lamp, the frame further including a surface surrounding the opening, comprising:

a. a first bracket connected to the frame, said first bracket including a first portion placed along the frame surface surrounding the opening and a second portion extending outwardly from the frame surface surrounding the opening, said first bracket second portion including a movable element;

b. first fastening means for connecting said first bracket to the frame, said first fastening means for connecting said first bracket to the frame including means for adjustably connecting said first bracket to the frame and further comprises one anchor fixed to the frame, a slot in said first bracket, and one fastener penetrating said slot, for holding said first bracket to the frame;

c. second fastening means for connecting said movable element to the trim, said second fastening means for connecting said movable element to the trim comprising means for hingedly attaching said movable element to the trim;

d. a second bracket connected to the frame, said second bracket including a first portion placed against the frame surface surrounding the opening, and a second portion extending outwardly from the frame surface;

e. third fastening means for connecting said second bracket to the frame; and f. fourth fastening means for connecting the trim to said second portion of said second bracket.

8. The apparatus of claim 7 in which said third fastening means for connecting said second bracket to the frame includes means for adjustably connecting said second bracket to the frame, and further comprises another anchor fixed to the frame, a slot in said second bracket and another fastener penetrating said slot for holding said second bracket to the frame.

9. The apparatus of claim 1 in which the frame further includes a rim surrounding the opening, and the frame surface comprises a surface on the rim.

10. The apparatus of claim 9 in which said second fastening means for connecting said movable element to the trim further comprises a slot through said movable element.

11. The apparatus of claim 10 in which said fourth fastening means includes means for permitting rotation of the trim relative to the surface surrounding the opening of the frame.

12. The apparatus of claim 11 in which said means for permitting rotation of the trim relative to the surface surrounding the opening comprises a slot in said second portion of said second bracket.

13. The apparatus of claim 12 in which said first fastening means for connecting said first bracket to the frame includes means for adjustably connecting said first bracket to the frame and further comprises one anchor fixed to the frame, a slot in said first bracket and one fastener penetrating said slot, for holding said first bracket to the frame.

14. The apparatus of claim 13 in which said third fastening means for connecting said second bracket to the frame includes means for adjustably connecting said second bracket to the frame, and further comprises another anchor fixed to the frame, a slot in said second bracket and another fastener penetrating said slot for holding said second bracket to the frame.

* * * * *